United States Patent [19]

Sardella

[11] 4,045,015

[45] Aug. 30, 1977

[54] ROTARY FEEDER FOR PAPERBOARD BLANKS

[75] Inventor: Louis M. Sardella, Towson, Md.

[73] Assignee: Wm. C. Staley Machinery Corporation, Hunt Valley, Md.

[21] Appl. No.: 757,158

[22] Filed: Jan. 6, 1977

[51] Int. Cl.[2] ..... B65H 3/64

[52] U.S. Cl. ..... 271/112; 271/114; 271/119

[58] Field of Search ..... 271/4, 10, 109, 112, 271/119, 114, 115

[56] References Cited

U.S. PATENT DOCUMENTS

| | | | |
|---|---|---|---|
| 2,394,410 | 2/1946 | Tascher | 271/119 |
| 3,486,749 | 12/1969 | Billings | 271/112 |
| 3,680,855 | 8/1972 | Brown | 271/112 |

*Primary Examiner*—Richard A. Schacher
*Attorney, Agent, or Firm*—Eric S. Spector

[57] ABSTRACT

A rotary feeder for paperboard blanks includes suction means, partially relieved feed wheels and a transmission with input and output shafts operatively connected so that the output shaft undergoes a controlled acceleration during an initial portion of each revolution of the input shaft and is stationary during a last portion of each revolution of the input shaft, whereby the wheels engage and grip a blank by means of static friction and move and accelerate that blank to the nip rolls without slippage occurring and so that each blank enters the nip rolls in register.

8 Claims, 6 Drawing Figures

ROTARY FEEDER FOR PAPERBOARD BLANKS

BACKGROUND OF THE INVENTION

This invention relates to apparatus for feeding paperboard blanks (such as corrugated blanks or sheets) one by one from the bottom of a stack of blanks to nip rolls (usually referred to in the art as feed rolls) for feeding to box-making machinery, such as printing, cutting, slotting, folding, or gluing machinery or the like. Such apparatus is known in the art as a feed table.

Most commercially available feeders include what is referred to in the art as kicker feed — a pusher member which is reciprocated to engage the trailing end of the blank to be fed, push such blank to the nip rolls, decelerate and come to the end of its stroke and then to return to its initial position to engage the trailing end of the next blank. Kicker feed machines will often jam or misfeed if, among other reasons, a blank is warped or the edge of a blank is crushed or ragged. Such jams necessitate unloading the hopper which causes significant production delays. Moreover, the moving pusher bar, in close proximity to the operator's hands, can be a safety hazard.

One commercially available feeder which does not rely on kicker feed includes a reciprocated suction shuttle member. This machine is described in Bishop et al U.S. Pat. No. 3,105,681. This feeder requires nip rolls which are partially relieved to accommodate the forward position of the shuttle member. Such partially relieved rolls present a deflection problem especially on wide machines. These machines also involve use of a relatively high vacuum (e.g. 10 psi of vaccum), involving a relatively expensive vacuum pump instead of a simple blower. The reciprocation involved in the operation of the Bishop feeder has a tendency to move the blank to be fed away from the gates thereby causing it to be fed out of register. The term "register" is used herein to mean that the leading edge of the blank being fed always enters the nip of the feed rolls at exactly the same point in each machine cycle.

It is an object of this invention to provide novel apparatus which does not have the operating and safety problems of kicker feed and which does not require relieved nip rolls or extremely high degrees of vacuum and which does not have a reciprocated shuttle member and therefore has an advantage in the consistency with which it feeds blanks in register.

BRIEF DESCRIPTION OF THE INVENTION

The above object is accomplished and the aforestated advantages are obtained by apparatus including rotary feed means and particularly comprising:

a. stack supporting structure;

b. feed means comprising wheels adapted to be rotated and each having i. an active portion with an exterior convexly curved contour with a high coefficient of friction and ii. a relieved portion;

c. transmission means comprising input shaft means which is adapted to be rotated and an output shaft means which is adapted to be rotated, said input and output shaft means being operatively connected so that the output shaft means undergoes a controlled acceleration during an initial portion of each revolution of said input shaft means and is stationary during a last portion of each revolution of said input shaft means;

d. means operatively connecting said output shaft means with said wheels so that during operation of the apparatus the wheels are rotated and undergo controlled acceleration followed by a net deceleration followed by a dwell period during which the wheels are in a dwell position;

e. suction means for urging a blank into contact with the feed means.

In a preferred embodiment the apparatus is for feeding blanks one by one from the bottom of a stack of blanks. In this embodiment the blanks are fed through an opening and then to the nip rolls and the apparatus includes gates means positioned above the supporting structure (leaving a gap or gaps to define the opening). The term "opening" is used herein to include a plurality of openings formed by a plurality of gates.

In a very preferred embodiment, the feed means is at least near the gate means and the curved contour of the active portion of each wheel extends between a leading edge and a trailing edge and has an extent slightly greater than the distance from the the opening at the gate means to the nip of the nip rolls and the suction means is at least near the gate means and is for operating on the lowermost blank.

In such apparatus the wheels engage and grip a blank by means of static friction (that is, both the blank and the wheels are at rest at the time of such engagement) and move and accelerate that blank to the nip rolls without slippage occurring (in other words, the blank moves as if geared to the feed wheels) and so that each blank enters the nip rolls in register.

The combination of the feed means in the form of partially relieved feed wheels and transmission means as described above are required herein. If the feed wheels are not partially relieved, they continue to be in engagement with a blank while the wheels are decelerating and after the blank is being pulled by the nip rolls resulting in the feed wheels working against the nip rolls. With a transmission providing controlled acceleration during an initial portion of each revolution of the input shaft, slippage will occur resulting in out of register feed. Without a transmission providing operation whereby the output shaft is stationary during the last portion of each revolution of the input shaft, initial engagement of a blank by the feed wheels is by sliding friction rather than static friction resulting in slippage and out of register feed.

The objects and advantages of the invention will be evident from the following detailed description.

DETAILED DESCRIPTION

Figure 1:
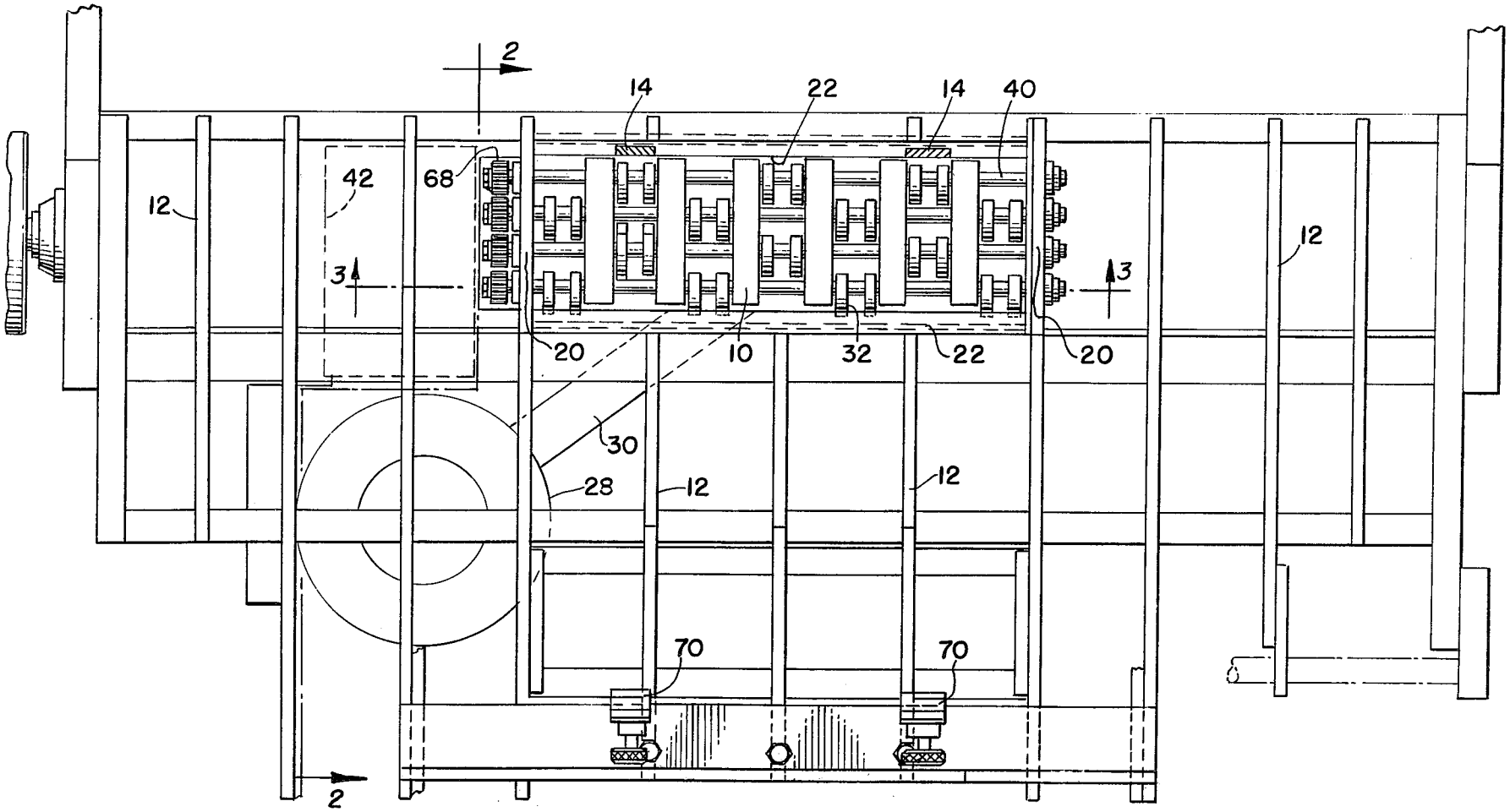
FIG. 1 is a plan view of preferred apparatus within the scope of this invention, with the feed wheels shown in dwell position ready to begin feeding and with the transmission depicted schematically and connections to the transmission left out.
Figure 2:
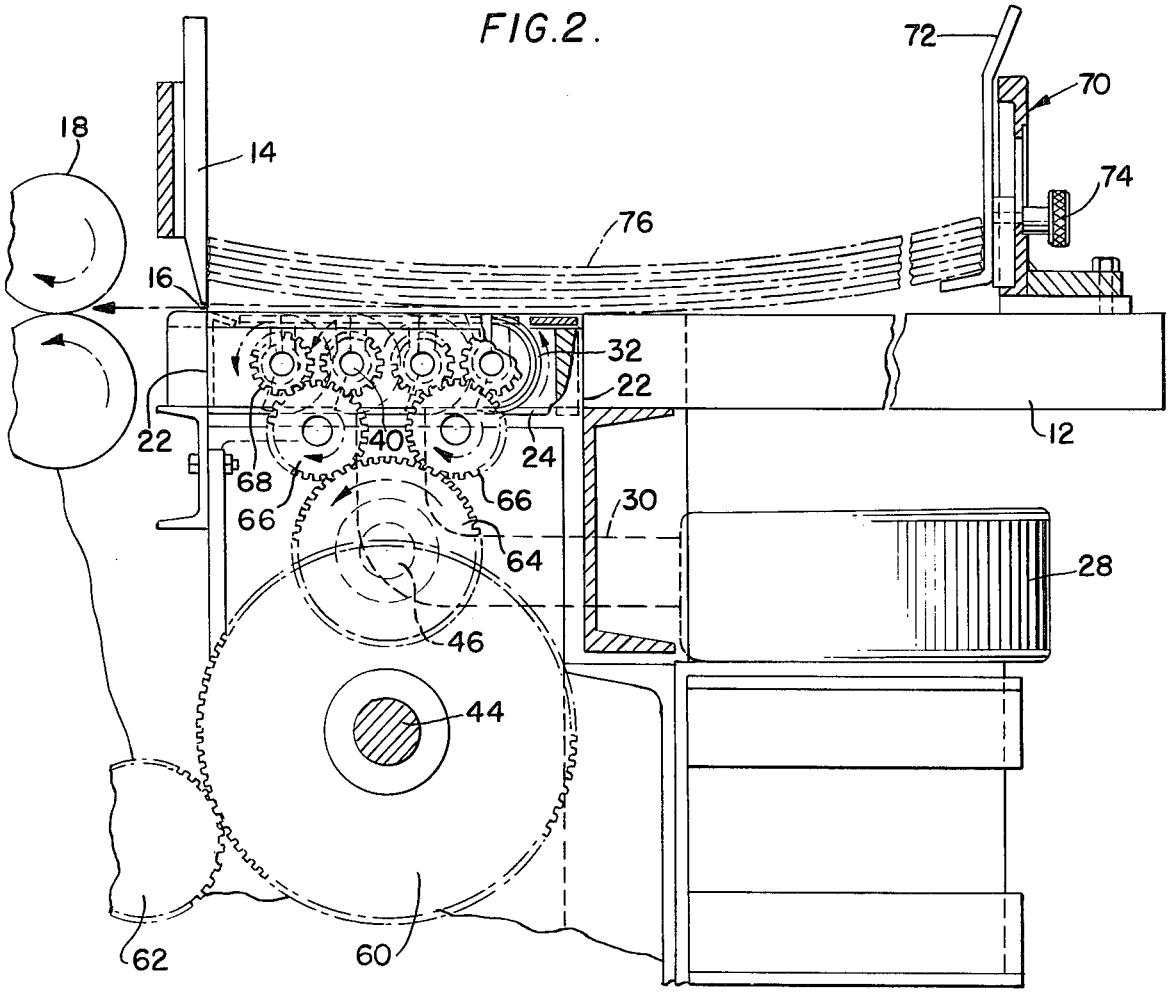
FIG. 2 is a vertical sectional view taken on line 2—2 of FIG. 1 with the transmission left out for simplification purposes and additionally depicting a stack of blanks in position to be fed one at a time.
Figure 3:
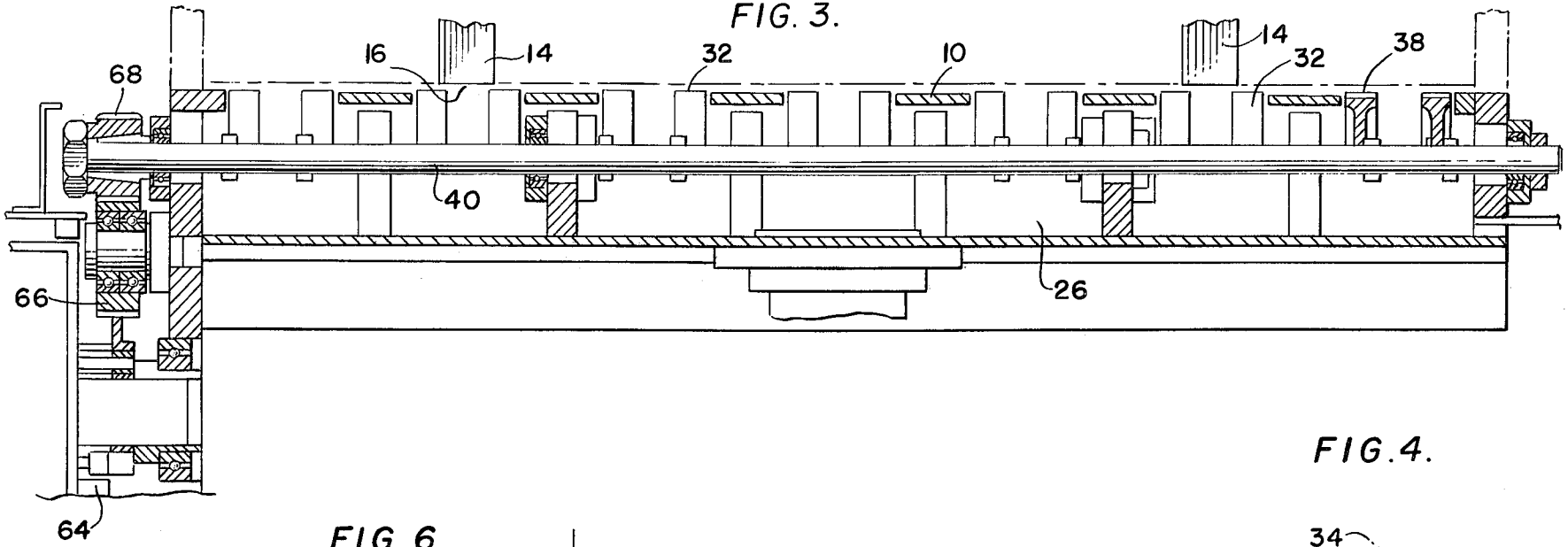
FIG. 3 is a vertical sectional view taken on line 3—3 of FIG. 1, except that the feed wheels are in a position where they would be feeding a blank.

Continuing reference is made to FIGS. 1, 2 and 3 of the drawings.

Stack supporting structure of the depicted apparatus includes six spaced, parallel bars 10, each positioned toward the front of the machine and so that its longitudinal dimension extends in the machine direction. Such structure also includes a plurality of other spaced, parallel bars 12, each having its longitudinal dimension extending in the machine direction. The bars 12 are positioned outward or back of the bars 10. The tops of the bars 10 and 12 lie in a common plane whereon a stack of blanks to be fed is loaded.

The stack supporting structure is mounted on frame structure as depicted in FIG. 2.

Gate means in the form of gate members 14 are positioned toward the front of the apparatus and above the supporting structure leaving gaps which define openings 16 (FIG. 2) through which the blanks are fed. The gate members 14 are adjustable outwardly or inwardly to accommodate the width of the blanks being fed. The gate members 14 are adjustable upwardly and downwardly to adjust the openings 16 to accommodate the thickness of a blank being fed.

Nip rolls (feed rolls) 18 are positioned downstream of opening 16. The foreward portions 20 of two of the bars 12 together with two spaced, parallel, transversely extending bars 22 and bottom structure 24 define a rectangular cross-section vacuum box 26 (see FIG. 3) which is near the gate means. Usually, the vacuum box 26 has an opening in its top extending backwardly (in the machine direction) from the opening of the gate means a distance ranging from about 6 inches to about 30 inches. (A very preferred structure has a vacuum box extending backwardly from the opening at the gate means about 12 and an opening in its top extending backwardly from the opening at the gate means about 10.5 inches). The vacuum box 26 communicates with a blower 28 (FIGS. 1 and 3) by means of appropriate ductwork 30. The vacuum box 26, blower 28 and ductwork 30 constitute a suction means. The suction means is for urging the lowermost blank into contact with the feed means a described below. The blower 28 preferably is sufficient to impart a vacuum of 20 to 50 inches of water, very preferably a vacuum of 30 to 40 inches of water, to a blank overlying the vacuum box. A very preferred blower 28 provides a maximum vacuum of 36 inches of water. The portions 20 are referred to hereinafter as vacuum box sidewalls.

Figure 4:
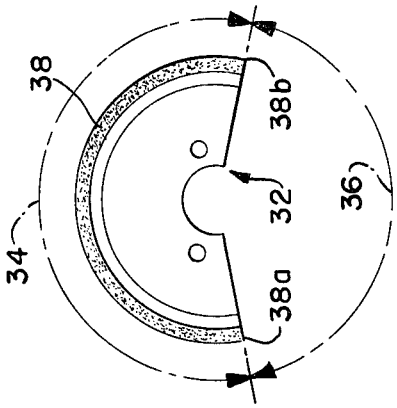
FIG. 4 is a detail elevational view of a feed wheel.

Feed means in the form of a plurality of feed wheels 32 are mounted in vacuum box 26 (that is near the gate means) and are adapted to be rotated. The wheels 32 (see FIG. 4) each comprise an active portion 34 and a relieved portion 36. The active portion 34 has a exterior convexly curved contour 38 with a high coefficient of friction. This high coefficient of friction contour is provided by a coating or layer of high coefficient or friction material (e.g. polyurethane, rubber, or the like). For simplification purposes only two of the feed wheels 32 are shown in section in FIG. 3. The curved contour of the active portion 34 of each feed wheel 32 extends between a leading edge 38*a* and a trailing edge 38*b* (FIG. 4) and has an extent slightly greater than the distance from the openings 16 at the gate means to the nip of the feed rolls 18 (sufficiently greater so that the feed rolls will start to pull the sheet as it disengages from the trailing edge of the active portion of each feed wheel). The radius of the active portion of each wheel is selected in regard to the characteristics of the transmission means so that a blank enters the nip rolls at the same velocity as the velocity of the surface of the nip rolls. There are 28 feed wheels 32 on the apparatus, four in each of seven compartments provided in the vacuum box by the bars 10 and vacuum box sidewalls 20. The feed wheels 32 are mounted on four spaced parallel shafts 40 which extend transversely (in the cross machine direction) between vacuum box sidewalls 20. As seen in FIG. 1, the feed wheels 32 are mounted in sets of two, with one set being on each of two nonadjacent shafts in a compartment with the sets in adjacent compartments being on different shafts; in other words the sets are mounted in staggered relationship. The feed wheels 32 are mounted on the shafts and the apparatus is adjustable so that the leading edges 38*a* of the feed wheels 32 are substantially level with the top of the stack supporting structure (that is with the common plane described earlier) when the wheels are in a dwell position (as described hereinafter).

The transmission means for the apparatus, generally indicated in FIG. 1 by reference numeral 42 is, as indicated above, a transmission comprising input shaft means in the form of a shaft 44 (FIG. 2) which is adapted to be rotated and output shaft means in the form of a shaft 46 (FIG. 2) which is adapted to be rotated with the shafts 44 and 46 operatively connected so that the output shaft means undergoes a controlled acceleration during an initial portion of each revolution of the input shaft means and is stationary during a last portion of each revolution of the input shaft means.

Figure 5:
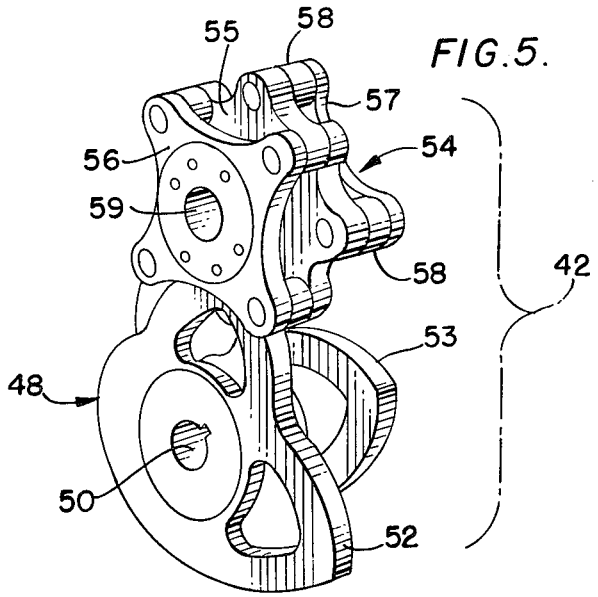
FIG. 5 is a perspective view of a transmission for, the apparatus of this invention except for the casing, bearing and shafts.

A very suitable transmission 42 having these characteristics is a parallel shaft index drive which is commercially available from Camco Commercial Division of Emerson Electric Company. A transmission of this type (with casing, bearings and shafts not depicted in order to simplify the depiction) is depicted in FIG. 5. The transmission depicted in FIG. 5 includes a conjugate cam 48 having a bore 50 for receiving the input shaft. The cam 48 has peripheral portions 52 and 53 of identical configuration transversely of their axis of rotation and each having lobes displaced relative to each other (so as to impart intermittent or indexing rotation to the output shaft). The transmission of FIG. 5 also includes a cam follower wheel 54 having a bore 59 for receiving an output shaft and comprising a central flange 55 and side flanges 56 and 57. The flange 55 is joined with flanges 56 and 57 by hub portions (not shown). The side flanges 56 and 57 form with the central flange 55 yoke portions which support roller shafts on which cam follower rollers 58 are mounted. Rotation of the input shaft rotates the conjugate cam 48 to rotate the cam follower wheel 54 and output shaft to provide the type of motion described above to the output shaft.

The input shaft 44 is driven from the main gear train of the boxmaking machine via transmission input gear 60 and idler gear 62.

The output shaft 46 is operatively connected to the feed wheels 32 and transmits motion to such feed wheels so that during operation of the apparatus the feed wheels are rotated and undergo controlled acceleration followed by deceleration followed by a dwell period during which the feed wheels are in stationary position (that is, in a dwell position). The connections between the output shaft 46 and the feed wheels comprise transmission output gear 64, idler gears 66, feed wheel shaft drive gears 68 and feed wheel shaft 40.

The apparatus includes structures 70 (FIGS. 1 and 2) slideably adjustable forwardly and backwardly to be positioned at the trailing end of a stack of sheets on the apparatus (such structure resembles conventional backstop structure — however, no backstop function is required since there is no reciprocating motion to drive the stack backwardly). Each structure 70 includes lifting means 72 which is vertically adjustable by means of screw 74 acting in concert with a slot. Two of the structures 70 are depicted (see FIG. 1). The function of the structures 70 is described below.

We turn now to the operation of the apparatus described above.

A stack of blanks (denoted by reference numeral 76 in FIG. 2) is loaded onto the machine and positioned abutting the rear surface of the gates 14. The gates 14 are adjusted vertically so that only a single sheet can be fed through openings 16 during each machine cycle (a machine cycle is the period in which an element of the box making machine which is supposed to make one revolution per blank, e.g., a printing cylinder, makes that revolution.) If a blank or stack of blanks is symmetrically warped concave up, the structures 70 are moved up to the trailing end of the stack and the elevating mechanisms 72 is adjusted vertically upwardly and fastened in position with screw 74 to lift the trailing end of the stack up thereby causing the forward end of the stack to move down toward vacuum box 26 as an aid to the vacuum box urging the forward end of the lowermost blank into engagement with the top surface of the bars 10; preferably the trailing end of the stack is elevated to pivot the stack until the curvature of the lowermost blank is tangent to the supporting structure at the rear end of the vacuum box whereby leakage into the vacuum box is minimized and vacuum effect on the sheet is maximized.

Then feeding is initiated by turning on power to the boxmaking machine, causing the blower 28 to operate (whereby the lowermost blank is flattened against the vacuum box) and initiating the driving of gear 62. The feeding operation is now described with continuing reference to FIG. 6 which depicts the relationship between feed wheel motion and revolutions of the main machine element for a preferred mode of operation of the apparatus described above.

Figure 6:
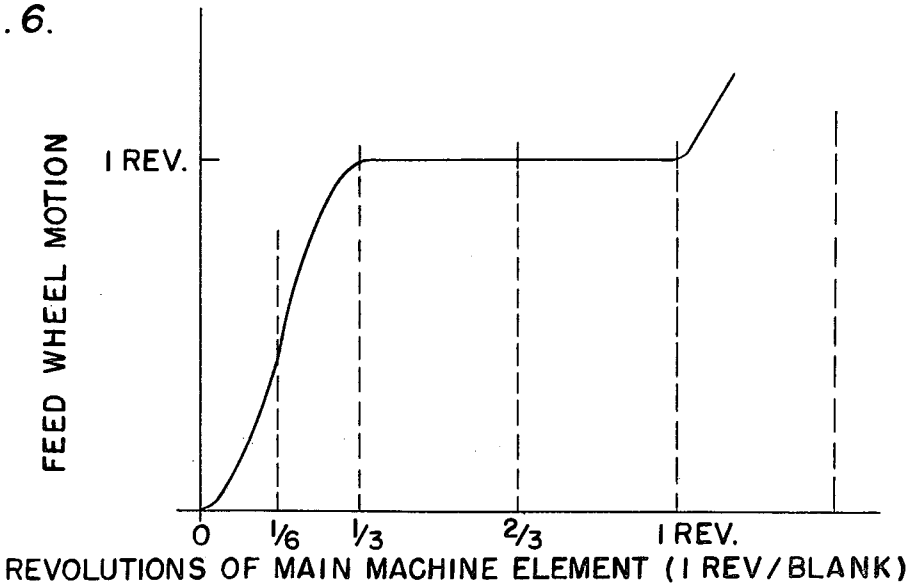
FIG. 6 is a graph illustrating the relationship between feed wheel motion and motion of the main machine element in a preferred mode of operation of apparatus depicted in FIGS. 1-5.

Input shaft 44 of transmission 42 is driven by gear 62 driving gear 60. The transmission receives the continuous input from shaft 44 and converts it into intermittent (indexing) drive and particularly causes the output shaft 46 to undergo a controlled acceleration during an initial portion of each revolution of the input shaft, then undergoes deceleration and finally is maintained stationary during a last portion of each revolution of the input shaft 44. The means operatively connecting the output shaft 46 and the feed wheels 32 as described above causes the feed wheels 32 to be rotated and to undergo controlled acceleration followed by deceleration followed by a dwell period during which the wheels are in dwell position. As is indicated in FIG. 6, in a preferred mode of operation, the feed wheels make one revolution and accelerate and decelerate during the first one-third revolution by the main machine element.

In particular, in this preferred mode of operation, when revolution of the main machine element is initiated, rotation of the feed wheels is initiated. Just prior to the initiation of such rotation, the feed wheels are in position with the leading edges of each substantially level with the top of the stack supporting structure and are engaging and gripping the lowermost blank (which is flattened against the vacuum box by means of the vacuum) by means of static friction. As rotation of the feed wheels is initiated, they move and accelerate that blank with a controlled acceleration and without slippage occurring so that the blank moves under the gates 14 through the openings 16 and to the nip of the feed rolls 18 and is accelerated so that it enters the nip in register and at the same velocity as the velocity of the surface of the nip rolls. With reference to FIG. 6, this operation whereby the feed wheels start at rest in engagement with a blank to be fed and move and accelerate the blank until it reaches the nip of the feed rolls occurs during the first sixth of a revolution of the main machine element. When the blank reaches the nip of the feed rolls, it is gripped by the feed rolls and is disengaged by the active portion of the feed wheels and is moved by the feed rolls into downstream machinery. During the next sixth of a revolution by the main machine element as indicated in FIG. 6, the feed wheels undergo controlled deceleration and come to rest having completed their rotation with the leading edge of the active surface of each feed wheel being slightly above the top of the stack supporting structure and in a position to grip and engage the next blank to be fed. During the last two-thirds of the revolution of the main machine element, the feed wheels are in a dwell position (that is, are stationary) and are therefore able to grip the next blank by means of static friction. As the blank being fed leaves the feeder under the influence of the feed rolls 18 and its trailing edge moves under the gates 14, the next lowermost blank is progressively exposed to the vacuum box and is flattened and is gripped and engaged by the feed wheels. This above described cycle is repeated to feed the blanks one by one.

The term "net deceleration" is used herein in relation to the feed wheels to mean that they undergo motion following the controlled acceleration whereby they come to be stationary for the dwell period.

The invention may be embodied in other specific forms without departing from the essential characteristics thereof.

For example, transmissions other than the one specifically depicted in FIG. 5 are suitable for use in the apparatus of this invention as long as the transmission has input and output shafts which are operatively connected so that the output shaft undergoes a controlled acceleration during an initial portion of each revolution of the input shaft and is stationary during a last portion of each revolution of the input shaft. A very suitable transmission is a right angle index drive available from Camco Commercial Cam Division of Emerson Electric comprising a barrel cam containing ribs defining a groove of serpentine configuration and a circular follower wheel having cam follower bearings which move in the groove along the ribs. Another transmission which is operative is a geneva mechanism; such mechanism supplies the right motion but has the disadvantage of a short life span. While transmission specifically described above provides controlled deceleration of the feed wheels, such deceleration need not be controlled, and the motion involved after the active portions of the feed wheels leave engagement with the blank being fed can even be oscillation provided the feed wheels are brought to a stop (dwell period) before the end of the cycle.

Moreover, the gears 66 operatively connecting the transmission output shaft with the feed wheels are readily replaced with other machine elements known to those skilled in the art, such as timing belts.

Furthermore, the contour of the feed wheel active portion need not be circular. It can be ovate or have other curvilinear configuration.

Furthermore, the blank supporting structure outside the vacuum box need not be spaced parallel bars. For example, a steel sheet or casting can be used as support structure.

Furthermore, the structures 70 at the rear of the apparatus are optional, and the apparatus is operative on most blanks without such structure.

Furthermore, an interrupt or skip feed means can be incorporated in the depicted machine. This feature can be incorporated by including a clutch in the output shaft from the transmission; operation involves declutching during the dwell period.

Furthermore, suction means can be included outboard or back of the vacuum box as depicted for operation on blanks warped very severely.

Moreover, while apparatus has been depicted where blanks are fed one by one from the bottom of a stack, the principles of this invention are equally applicable where blanks are fed one by one from the top of a stack. Such apparatus includes an overhead vacuum box and overhead feed wheels of the type described above driven by a transmission of the type described above and elevator or lift mechanism to lift the stack as blanks are fed.

In view of the variations that are readily understood to come within the limits of the invention, such limits are defined by the scope of the claims.

The term "opening in its top" is used herein in relation to the vacuum box to mean the opening defined by portions 20 and bars 22.

What is claimed is:

1. Apparatus for feeding paperboard blanks one by one from a stack of blanks to nip rolls for feeding to printing, cutting, slotting, folding, gluing or the like machinery, said apparatus comprising a. stack supporting structure;

b. feed means comprising wheels adapted to be rotated and each having i. an active portion with an exterior convexly curved contour with a high coefficient of friction and ii. a relieved portion;

c. transmission means comprising input shaft means which is adapted to be rotated and an output shaft means which is adapted to be rotated, said input and output shaft means being operatively connected so that the output shaft means undergoes a controlled acceleration during an initial portion of each revolution of said input shaft means and is stationary during a last portion of each revolution of said input shaft means;

d. means operatively connecting said output shaft means with said wheels so that during operation of the apparatus the wheels are rotated and undergo controlled acceleration followed by a net deceleration followed by a dwell period during which the wheels are in a dwell position;

e. suction means for urging a blank into contact with the feed means;

whereby the wheels engage and grip a blank by means of static friction and move and accelerate that blank to the nip rolls without slippage occuring and so that each blank enters the nip rolls in register whereupon the blank is disengaged from the wheels.

2. Apparatus as recited in claim 1 which is for feeding paperboard blanks one by one from the bottom of the stack of blanks through an opening and then to the nip rolls and which includes gates means positioned above the supporting structure to define the opening.

3. Apparatus as recited in claim 2 in which the feed means is at least near the gate means and the curved contour of the active portion of each wheel extends between a leading edge and a trailing edge and has an extent slightly greater than the distance from the opening at the gate means to the nip of the nip rolls and in which the suction means is at least near the gate means and is for operating on the lowermost blank.

4. Apparatus as recited in claim 3 in which the supporting sructure comprises spaced parallel bars, each positioned so its longitudinal dimension is in the machine direction.

5. Apparatus as recited in claim 3 in which the suction means comprises a vacuum box having an opening in its top, said opening extending backwardly from the opening at the gate means a distance ranging from about 6 to about 30 inches, and in which the wheels are mounted in the vacuum box.

6. Apparatus as recited in claim 5 in which the wheels are associated in sets and the sets are mounted in staggered relatioship in respect to one another.

7. Apparatus as recited in claim 3 in which the radius of the active portion of each wheel is selected in regard to the characteristics of the transmission means so that a blank being fed enters the nip rolls at the same velocity as the velocity of the surface of the nip rolls.

8. Apparatus as recited in claim 3 in which the suction means comprises a vacuum box having an opening in in its top, said opening extending backwardly from the opening at the gate means a distance ranging from about 6 to about 30 inches, and in which the apparatus also comprises structure adapted to be positioned at the trailing end of the stack and to elevate said trailing end and pivot said stack minimize leakage into the vacuum box when feeding blanks warped concave up.

* * * * *

UNITED STATES PATENT OFFICE

CERTIFICATE OF CORRECTION

PATENT NO. : 4,045,015

DATED : August 30, 1977

INVENTOR(S) : Louis M. Sardella

It is certified that error appears in the above-identified patent and that said Letters Patent are hereby corrected as shown below:

Column 2, line 38, "With" should be --Without--.

Column 3, line 40, "inches" should be inserted after "12".

Column 5, line 4, "shaft 40" should be --shafts 40--.

Column 8, line 43, "relatioship" should be --relationship--.

Column 8, line 56, "to" should be inserted after "stack".

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*